US009574813B2

(12) United States Patent
Pei et al.

(10) Patent No.: US 9,574,813 B2
(45) Date of Patent: Feb. 21, 2017

(54) CONTAINER-TYPE REFRIGERATION SYSTEM

(71) Applicant: Huawei Technologies Co., Ltd., Shenzhen, Guangdong (CN)

(72) Inventors: Zhongqing Pei, Shenzhen (CN); Xiaoming Kong, Shenzhen (CN); Haiping Chen, Shenzhen (CN); Yong Tang, Xi'an (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 441 days.

(21) Appl. No.: 14/136,197

(22) Filed: Dec. 20, 2013

(65) Prior Publication Data

US 2014/0190200 A1 Jul. 10, 2014

Related U.S. Application Data

(63) Continuation of application No. PCT/CN2011/076134, filed on Jun. 22, 2011.

(51) Int. Cl.

| | |
|---|---|
| ***F25D 3/08*** | (2006.01) |
| ***F25D 11/00*** | (2006.01) |
| ***B65D 88/74*** | (2006.01) |
| ***F25D 19/00*** | (2006.01) |
| ***F25D 19/04*** | (2006.01) |

(52) U.S. Cl.

CPC ..... *F25D 11/003* (2013.01); *B65D 88/74* (2013.01); *F25D 19/003* (2013.01); *F25D 19/04* (2013.01)

(58) Field of Classification Search

CPC ..... F25D 11/003; F25D 19/003; F25D 19/04; B65D 88/74

See application file for complete search history.

(56) References Cited

U.S. PATENT DOCUMENTS

| | | | | |
|---|---|---|---|---|
| 3,768,686 | A | 10/1973 | Mappes | |
| 3,961,925 | A * | 6/1976 | Rhoad | B65D 88/745 134/123 |
| 4,836,395 | A | 6/1989 | Goutille | |
| 5,987,910 | A | 11/1999 | Kothe et al. | |
| 6,463,705 | B1 | 10/2002 | Davis et al. | |

(Continued)

FOREIGN PATENT DOCUMENTS

| | | | |
|---|---|---|---|
| CN | 86101185 | A | 10/1986 |
| CN | 1187451 | A | 7/1998 |

(Continued)

*Primary Examiner* — Elizabeth Martin

(57) ABSTRACT

Container-type refrigeration systems. A container includes an upper beam assembly, a lower beam assembly, a first end wall assembly, and a second end wall assembly, the upper beam assembly is spaced from the lower beam assembly to form a first accommodation space between the upper beam assembly and the lower beam assembly, the upper beam assembly and the lower beam assembly each has one end connected to the first end wall assembly and the other end connected to the second end wall assembly to form a second accommodation space above the upper beam assembly and between the first end wall assembly and the second end wall assembly, the first accommodation space is isolated from the second accommodation space through the upper beam assembly, the second accommodation space has a water chilling unit.

15 Claims, 3 Drawing Sheets

(56) References Cited

U.S. PATENT DOCUMENTS

| | | | | |
|---|---|---|---|---|
| 2004/0016245 | A1 | 1/2004 | Pierson | |
| 2006/0082263 | A1* | 4/2006 | Rimler | B60P 3/14 312/201 |
| 2006/0118504 | A1* | 6/2006 | Willemsen | B08B 9/093 211/189 |
| 2008/0060372 | A1 | 3/2008 | Hillis et al. | |
| 2010/0051563 | A1 | 3/2010 | Schreiber | |
| 2010/0170277 | A1 | 7/2010 | Schmitt et al. | |
| 2010/0300650 | A1 | 12/2010 | Bean, Jr. | |
| 2011/0056651 | A1 | 3/2011 | Monk et al. | |
| 2012/0134107 | A1 | 5/2012 | Peng et al. | |
| 2014/0254085 | A1* | 9/2014 | Slessman | B31B 43/00 361/679.31 |

FOREIGN PATENT DOCUMENTS

| | | | |
|---|---|---|---|
| CN | 2365170 | Y | 2/2000 |
| CN | 2460348 | Y | 11/2001 |
| CN | 1357073 | A | 7/2002 |
| CN | 2701794 | Y | 5/2005 |
| CN | 1844810 | A | 10/2006 |
| CN | 002837247 | Y | 11/2006 |
| CN | 101122438 | A | 2/2008 |
| CN | 201501642 | U | 6/2010 |
| CN | 201672737 | U | 12/2010 |
| CN | 102063166 | A | 5/2011 |
| JP | H0858464 | A | 3/1996 |
| JP | 2008076039 | A | 4/2008 |
| WO | WO 2009/137215 | A2 | 11/2009 |
| WO | WO 2010/065903 | A1 | 6/2010 |

* cited by examiner

CONTAINER-TYPE REFRIGERATION SYSTEM

CROSS-REFERENCE TO RELATED APPLICATIONS

This application is a continuation of International Application No. PCT/CN2011/076134, filed on Jun. 22, 2011, which is hereby incorporated by reference in its entirety.

TECHNICAL FIELD

The present invention relates to the transportation field, and in particular, to a container type refrigeration system.

BACKGROUND

A container is a large cargo container that has certain strength, rigidity, and specification and is specially designed for turnaround. To meet the requirements of refrigeration integration, fast delivery, and fast installation and operation, a corollary refrigeration system is installed on the container.

An existing container type refrigeration system can be put into use as long as water and electricity are connected after the system is deployed in an outdoor location. The refrigeration system generally adopts a container in a single-layer structure, or adopts more than 2 containers and other corollary devices. All refrigeration units of the refrigeration system are placed side by side.

In the process of implementing the present invention, the inventor finds at least the following problems in the prior art: with only one container, the refrigeration capacity is low; and with more than 2 containers and other corollary devices, the integration extent is low; the installation is complicated, which affects costs and construction duration; and the refrigeration units placed side by side make maintenance inconvenient.

SUMMARY

To solve the problems in the prior art, embodiments of the present invention provide a container type refrigeration system that has one container, a high refrigeration capacity, and a high integration extent.

The technical solution is as follows: A container type refrigeration system is provided, where the container includes an upper beam assembly, a lower beam assembly, a first end wall assembly, and a second end wall assembly, the upper beam assembly is spaced from the lower beam assembly to form a first accommodation space between the upper beam assembly and the lower beam assembly, the upper beam assembly and the lower beam assembly each has one end connected to the first end wall assembly and the other end connected to the second end wall assembly to form a second accommodation space above the upper beam assembly and between the first end wall assembly and the second end wall assembly, the first accommodation space is isolated from the second accommodation space through the upper beam assembly, the second accommodation space has a water chilling unit, and the first accommodation space has a water channel system.

The technical solution of the embodiments of the present invention brings the following benefits: The embodiments of the present invention put forward a two-layer container, which has an upper layer for installing a water chilling unit and a lower layer for installing a water channel system, thereby effectively utilizing the space in the longitudinal direction of the container and providing the merits of a high refrigeration capacity and a high integration extent.

DESCRIPTION OF THE COMPONENTS

1 upper beam assembly, 11 first upper long horizontal beam, 12 second upper long horizontal beam;
2 lower beam assembly, 20 first accommodation space, 21 first lower long horizontal beam, 22 second lower long horizontal beam;
3 first end wall assembly, 30 second accommodation space, 31 vertical pole, 32 first horizontal beam, 33 second horizontal beam, 34 third horizontal beam, 35 ramp beam;
4 second end wall assembly;
5 vertical beam, 51 first vertical beam, 52 second vertical beam;
61 first ramp beam, 62 second ramp beam;
7 upper horizontal beam;
8 lower horizontal beam;
9 reinforcing beam;
10 water chilling unit, 101 refrigeration unit, 102 power distribution cabinet, 103 pneumatic tank;
110 water channel system, 111 chilling water tank, 112 pipeline and valve.

DESCRIPTION OF EMBODIMENTS

To make the objectives, technical solutions, and advantages of the present invention more comprehensible, the following further describes the embodiments of the present invention in detail with reference to the accompanying drawings.

Figure 1:
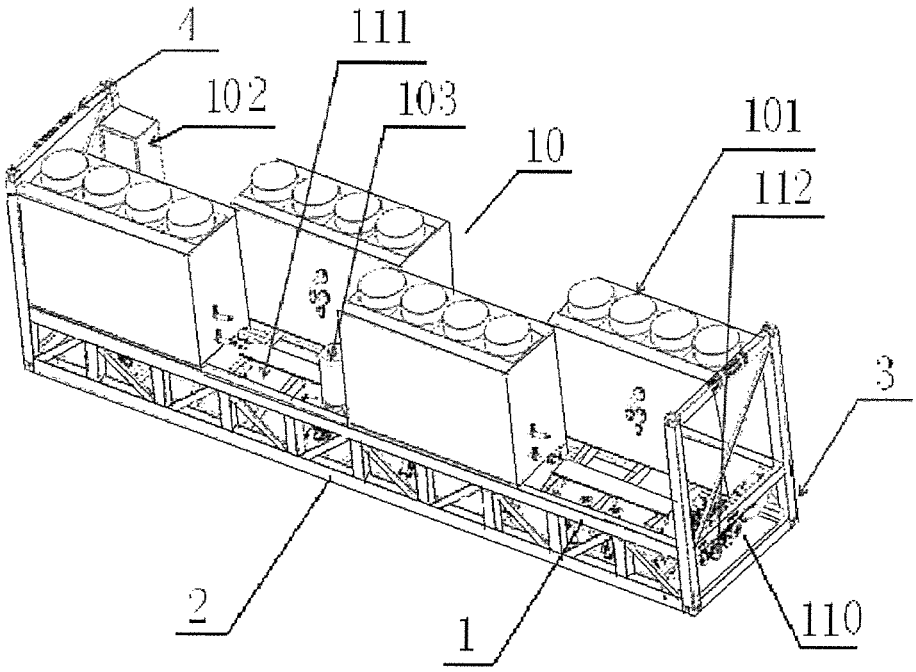
FIG. 1 is a schematic structural diagram of a container type refrigeration system according to an embodiment of the present invention.

Referring to FIG. 1, a container type refrigeration system includes an upper beam assembly 1, a lower beam assembly 2, a first end wall assembly 3, and a second end wall assembly 4, the upper beam assembly 1 is spaced from the lower beam assembly 2 to form a first accommodation space 20 between the upper beam assembly 1 and the lower beam assembly 2, the upper beam assembly 1 and the lower beam assembly 2 each has one end connected to the first end wall assembly 3 and the other end connected to the second end wall assembly 4 to form a second accommodation space 30 above the upper beam assembly 1 and between the first end wall assembly 3 and the second end wall assembly 4, the first accommodation space 20 is isolated from the second accommodation space 30 through the upper beam assembly, the second accommodation space 30 has a water chilling unit 10, and the first accommodation space 20 has a water channel system 110.

In the embodiment of the present invention, a first accommodation space 20 is set between an upper beam assembly and a lower beam assembly of a container, the first accommodation space 20 is used to accommodate a water channel system of a refrigeration system, and a second accommodation space 30 above the upper beam assembly accommodates a water chilling unit, thereby improving the utilization rate of the space in the longitudinal direction of the container and providing the merits of a high refrigeration capacity and a high integration extent.

Referring to FIG. 1, the water chilling unit 10 includes more than two refrigeration units 101, a power distribution cabinet 102, and a pneumatic tank 103; adjacent refrigeration units 101 are set alternately along a lengthwise direction of the container, and the power distribution cabinet 102 and the pneumatic tank 103 are respectively set in a spacing between the alternately set refrigeration units 101; the water channel system 110 includes a chilling water tank 111 and a pipeline and valve 112, and the chilling water tank 111 is set in the first accommodation space 20 and communicated with the pipeline through the valve.

In the embodiment of the present invention, the refrigeration units alternated on the upper layer ensure that equipment is maintainable 360 degrees. The open-ended framework structure facilitates heat dissipation and transportation of the equipment.

Referring to FIG. 1, preferably, the number of the refrigeration units 101 is 4, which are set in two rows, and each row has two spaced refrigeration units.

With the alternate deployment in the embodiment of the present invention, air inlets of 4 refrigeration units are deployed evenly to ensure a maximum refrigeration capacity. In practical application, one refrigeration unit may be standby, and 3 refrigeration units work simultaneously. A unit has a refrigeration capacity of over 100 KW. With the water channel system, power distribution, and refrigeration in the embodiment of the present invention, a total refrigeration capacity of 300 KW is integrated in a scope of a standard container of a 40-foot height. Meanwhile, a duration of 10 minutes of 300 KW refrigeration persists after power-off.

Figure 2:
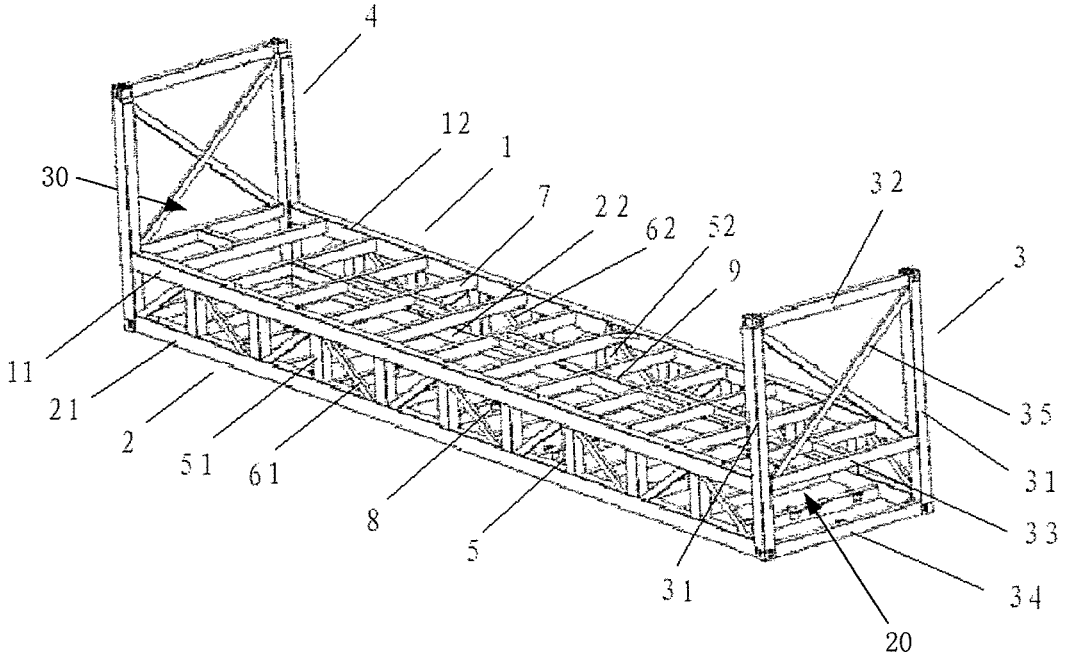
FIG. 2 is a schematic structural diagram of a framework container according to an embodiment of the present invention.

The container in the embodiment of the present invention has the following structure:

Referring to FIG. 2, a container includes an upper beam assembly 1, a lower beam assembly 2, a first end wall assembly 3, and a second end wall assembly 4, the upper beam assembly 1 is spaced from the lower beam assembly 2 to form a first accommodation space 20 between the upper beam assembly 1 and the lower beam assembly 2, the upper beam assembly 1 and the lower beam assembly 2 each has one end connected to the first end wall assembly 3 and the other end connected to the second end wall assembly 4 to form a second accommodation space 30 above the upper beam assembly 1 and between the first end wall assembly 3 and the second end wall assembly 4, and the first accommodation space 20 is isolated from the second accommodation space 30 through the upper beam assembly. To achieve better support between the upper beam assembly and the lower beam assembly, vertical beams 5 are set between the upper beam assembly 1 and the lower beam assembly 2, one end of each of the vertical beams 5 is connected to the upper beam assembly 1, and the other end is connected to the lower beam assembly 2.

Preferably, the vertical beams include more than two first vertical beams 51 and second vertical beams 52. The first vertical beams 51 are set outside one side of the upper beam assembly 1 and the lower beam assembly 2, and the second vertical beams 52 are set outside the other side of the upper beam assembly 1 and the lower beam assembly 2.

Referring to FIG. 2, to strengthen the bearing capacity of the vertical beams, first ramp beams 61 are set between adjacent first vertical beams 51, and second ramp beams 62 are set between adjacent second vertical beams 52. Adjacent first ramp beams 61 are set in a V shape, and adjacent second ramp beams 62 are set in a V shape.

Referring to FIG. 2, a container includes an upper beam assembly 1 and a lower beam assembly 2, where a first accommodation space 20 is set between the upper beam assembly 1 and the lower beam assembly 2, a second accommodation space 30 is set above the upper beam assembly 1, the upper beam assembly 1 includes a first upper long horizontal beam 11 and a second upper long horizontal beam 12 that are set oppositely, the lower beam assembly 2 includes a first lower long horizontal beam 21 and a second lower long horizontal beam 22 that are set oppositely, the first upper long horizontal beam 11 and the second upper long horizontal beam 12 each has one end connected to a first end wall assembly 3, and the other end connected to a second end wall assembly 4, the first lower long horizontal beam 21 and the second lower long horizontal beam 22 each has one end connected to the first end wall assembly 3, and the other end connected to the second end wall assembly 4.

In the embodiment of the present invention, a first accommodation space 20 is set between an upper beam assembly and a lower beam assembly of a container, and a second accommodation space is set above the upper beam assembly, thereby implementing two-layer independent bearing, improving a utilization rate of the space in the longitudinal direction and the bearing capacity of the container.

Referring to FIG. 2, to further improve the bearing capacity of the container, a first lower long horizontal beam 21 is set right under the first upper long horizontal beam 11 in parallel. The first upper long horizontal beam 11 may also have an angle of less than 90 degrees against the first lower long horizontal beam 21. In certain spacing between the first upper long horizontal beam 11 and the first lower long horizontal beam 21, multiple first vertical beams 51 are set. One end of each of the first vertical beams 51 is connected to the first upper long horizontal beam 11, and the other end is connected to the first lower long horizontal beam 21, and the first vertical beams 51 are perpendicular to the first lower long horizontal beam 21. A second lower long horizontal beam 22 is set right under the second upper long horizontal beam 12 in parallel. The second upper long horizontal beam 12 may also have an angle of less than 90 degrees against the second lower long horizontal beam 22. Between the second upper long horizontal beam 12 and the second lower long horizontal beam 22, second vertical beams 52 are set. One end of each of the second vertical beams 52 is connected to the second upper long horizontal beam 12, and the other end is connected to the second lower long horizontal beam 22, and the second vertical beams 52 are perpendicular to the second lower long horizontal beam 22.

Referring to FIG. 2, to further enhance the bearing capacity of the container as a whole, at least one upper horizontal beam 7 is set between the first upper long horizontal beam 11 and the second upper long horizontal beam 12 that are parallel. One end of the upper horizontal beam 7 is connected to the first upper long horizontal beam 11, and the other end is connected to the second upper long horizontal beam 12, and adjacent upper horizontal beams 7 may be set in parallel. Besides, the upper horizontal beams 7 are perpendicular to the first upper long horizontal beam 11. Also, at least one lower horizontal beam 8 is set between the first lower long horizontal beam 21 and the second lower long horizontal beam 22 that are parallel. One end of the lower horizontal beam 8 is connected to the first lower long horizontal beam 21, and the other end is connected to the second lower long horizontal beam 22, and adjacent lower horizontal beams 8 may be set in parallel. Besides, the lower horizontal beams 8 are perpendicular to the first lower long horizontal beam 21.

Referring to FIG. 2, to increase the bearing capacity of the upper beam assembly, reinforcing beams 9 are set between adjacent upper horizontal beams 7, the reinforcing beams 9 are parallel to the first upper long horizontal beams 11, and adjacent reinforcing beams 9 may also be spaced.

Figure 3:
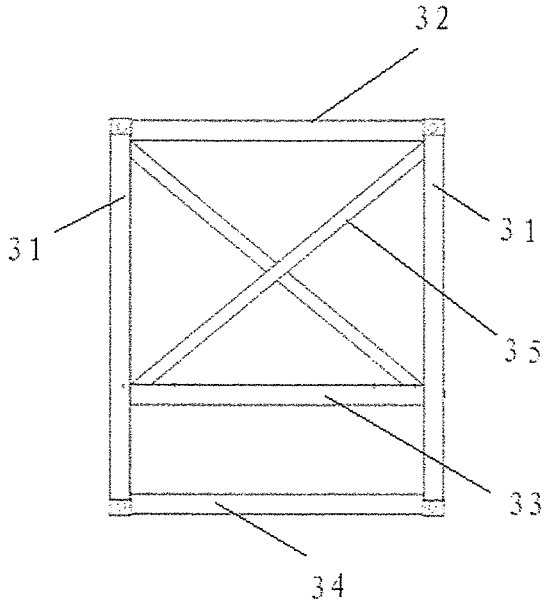
FIG. 3 is a schematic structural diagram of a first end wall assembly according to an embodiment of the present invention.

Referring to FIG. 3, both the first end wall assembly 3 and the second end wall assembly 4 include horizontal beams and two opposite vertical poles. The two opposite vertical poles are connected through the horizontal beams. The horizontal beams are a first horizontal beam 32, a second horizontal beam 33, and a third horizontal beam 34 that are set between the two vertical poles in order. The first horizontal beam 32 is connected to the top of the two opposite vertical poles 31, the third horizontal beam 34 is connected to the bottom of the two opposite vertical poles 31, and the second horizontal beam 33 is set between the first horizontal beam 32 and the third horizontal beam 34. Both ends are connected onto the vertical pole 31. Crossed ramp beams 35 are set between the first horizontal beam 32 and the second horizontal beam 33.

Referring to FIG. 2, the second horizontal beam 32 and the upper beam assembly 1 may be set on the same plane, this is, parallel to the upper horizontal beam 7. The third horizontal beam 33 is parallel to the lower horizontal beam 8.

Referring to FIG. 2, preferably, the first end wall assembly 4 and the second end wall assembly 3 have the same structure.

All connections of the container in the present invention are welded connections.

The body of the container in the embodiment of the present invention is made of welded section steel. Its outline dimensions are 40'×8'×9'6" ISO 1AAA in a standard 40-foot structure, and all 8 corners are standard container corner fittings. The upper layer of the two-layer container has a load bearing capability of 12 tons, and the lower layer has a load bearing capability of 8 tons.

The container type refrigeration system in the embodiment of the present invention has the following merits:

1. The highly integrated two-layer framework integrates 4 refrigeration units of a refrigeration capacity greater than 100 KW and corollary water channel systems.

2. The open-ended structure facilitates heat dissipation and transportation of equipment, and refrigeration units are alternated on the upper layer to facilitate installation and maintenance.

3. The standard modular structure facilitates manufacturing in a factory, meets requirements of fast production and cost-effectiveness, and facilitates capacity expansion.

4. The standard container interface facilitates transportation on a road or sea in the same way as an ordinary container.

The foregoing descriptions are merely exemplary embodiments of the present invention, but are not intended to limit the present invention. Any modification, equivalent replacement, or improvement derived within the spirit and principle of the present invention shall fall within the protection scope of the present invention.

What is claimed is:

1. A container type refrigeration system comprising a container, the container comprising:

an upper beam assembly;

a lower beam assembly;

a first end wall assembly; and a second end wall assembly, wherein the upper beam assembly is spaced from the lower beam assembly to form a first accommodation space between the upper beam assembly and the lower beam assembly, the upper beam assembly and the lower beam assembly each has one end connected to the first end wall assembly and the other end connected to the second end wall assembly to form a second accommodation space above the upper beam assembly and between the first end wall assembly and the second end wall assembly, the first accommodation space is isolated from the second accommodation space through the upper beam assembly, the second accommodation space has a water chilling unit, and the first accommodation space has a water channel system, and wherein the water chilling unit comprises four refrigeration units set alternately along a lengthwise direction of the container so that two of the refrigeration units are alternately placed and evenly spaced on each side of the container so that air inlets of the refrigeration units are evenly spaced within the container.

2. The container type refrigeration system according to claim 1, wherein:

the water chilling unit also comprises a power distribution cabinet and a pneumatic tank, wherein the power distribution cabinet and the pneumatic tank are respectively set in a spacing between the alternately set refrigeration units; the water channel system comprises a chilling water tank and a pipeline and valve, and the chilling water tank is set in the first accommodation space and communicated with the pipeline through the valve.

3. The container type refrigeration system according to claim 2, wherein:

the number of the refrigeration units is 4, which are set in two rows, and each row has two spaced refrigeration units.

4. The container type refrigeration system according to claim 1, wherein:

vertical beams are set between the upper beam assembly and the lower beam assembly, one end of each of the vertical beams is connected to the upper beam assembly, and the other end is connected to the lower beam assembly.

5. The container type refrigeration system according to claim 4, wherein:

the vertical beams comprise more than two first vertical beams and second vertical beams; the first vertical beams are set outside one side of the upper beam assembly and the lower beam assembly, and the second vertical beams are set outside the other side of the upper beam assembly and the lower beam assembly.

6. The container type refrigeration system according to claim 5, wherein:

first ramp beams are set between adjacent first vertical beams, and second ramp beams are set between adjacent second vertical beams; adjacent first ramp beams are set in a V shape, and adjacent second ramp beams are set in a V shape.

7. The container type refrigeration system according to claim 1, wherein:

the upper beam assembly comprises a first upper long horizontal beam and a second upper long horizontal beam that are set oppositely, the lower beam assembly comprises a first lower long horizontal beam and a second lower long horizontal beam that are set oppositely, the first upper long horizontal beam and the second upper long horizontal beam each has one end connected to the first end wall assembly respectively, and the other end connected to the second end wall assembly respectively.

8. The container type refrigeration system according to claim 7, wherein:

the first upper long horizontal beam and the first lower long horizontal beam are located on one side, and more than two first vertical beams are set between the first upper long horizontal beam and the first lower long horizontal beam; the second upper long horizontal beam and the second lower long horizontal beam are located on the other side, and more than two second vertical beams are set between the second upper long horizontal beam and the second lower long horizontal beam.

9. The container type refrigeration system according to claim 7, wherein:

more than two upper horizontal beams are set between the first upper long horizontal beam and the second upper long horizontal beam, one end of each of the upper horizontal beams is connected to the first upper long horizontal beam, and the other end is connected to the second upper long horizontal beam.

10. The container type refrigeration system according to claim 7, wherein:

reinforcing beams are set between adjacent upper horizontal beams, and the reinforcing beams are parallel to the first upper long horizontal beam.

11. The container type refrigeration system according to claim 7, wherein:

at least one lower horizontal beam is set between the first lower long horizontal beam and the second lower long horizontal beam, one end of the lower horizontal beam is connected to the first lower long horizontal beam, and the other end is connected to the second lower long horizontal beam.

12. The container type refrigeration system according to claim 11, wherein:

all the connections are welded connections.

13. The container type refrigeration system according to claim 1, wherein:

both the first end wall assembly and the second end wall assembly comprise horizontal beams and two opposite vertical poles, and the two opposite vertical poles are connected through the horizontal beams.

14. The container type refrigeration system according to claim 13, wherein:

the horizontal beams comprise a first horizontal beam, a second horizontal beam, and a third horizontal beam that are set in order, the first horizontal beam is connected to the top of the two opposite vertical poles, the third horizontal beam is connected to the bottom of two opposite vertical poles, and crossed ramp beams are set between the first horizontal beams and the second horizontal beams.

15. The container type refrigeration system according to claim 14, wherein:

the second horizontal beam and the upper beam assembly are set on a same plane.

* * * * *